US011330382B2

(12) United States Patent
McIntosh et al.

(10) Patent No.: US 11,330,382 B2
(45) Date of Patent: May 10, 2022

(54) ACOUSTICAL PROTECTOR FOR AUDIO DEVICES AND AUDIO DEVICE PROVIDED WITH SAID PROTECTOR

(71) Applicant: SAATI S.p.A., Appiano Gentile (IT)

(72) Inventors: Jason McIntosh, Appiano Gentile (IT); Paolo Canonico, Appiano Gentile (IT)

(73) Assignee: SAATI S.p.A., Appiano Gentile (IT)

( * ) Notice: Subject to any disclaimer, the term of this patent is extended or adjusted under 35 U.S.C. 154(b) by 0 days.

(21) Appl. No.: 17/274,076

(22) PCT Filed: Oct. 3, 2018

(86) PCT No.: PCT/IB2018/057666

§ 371 (c)(1),
(2) Date: Mar. 8, 2021

(87) PCT Pub. No.: WO2020/070542

PCT Pub. Date: Apr. 9, 2020

(65) Prior Publication Data

US 2021/0258705 A1 Aug. 19, 2021

(51) Int. Cl.
*H04R 25/00* (2006.01)
*H04R 1/02* (2006.01)
(Continued)

(52) U.S. Cl.
CPC ..... *H04R 25/654* (2013.01); *H04R 1/023* (2013.01); *H04R 1/1016* (2013.01);
(Continued)

(58) Field of Classification Search
CPC .... H04R 25/654; H04R 1/023; H04R 1/1016; H04R 1/2823; H04R 11/02; H04R 2225/023
See application file for complete search history.

(56) References Cited

U.S. PATENT DOCUMENTS 5,150,417 A 9/1992 Stahl
5,278,360 A * 1/1994 Carbe ..... H04R 25/654 181/135
(Continued)

FOREIGN PATENT DOCUMENTS

EP 835042 A2 4/1998
EP 2493216 A2 8/2012
JP H11308689 A 11/1999

OTHER PUBLICATIONS

Navarri, Massimo, International Search Report from the European Patent Office in PCT/IB2018/057666, dated Jun. 17, 2019.

*Primary Examiner* — Sunita Joshi

(74) *Attorney, Agent, or Firm* — Greer Burns & Crain, Ltd.

(57) ABSTRACT

An acoustically transparent protector for an audio device provided with a sound generating transducer having a sound port covered by said protector for use with a human ear for the reproduction of sound which allows sound to pass through with little attenuation or distortion but does not allow foreign material such as ear wax, dust, debris, or water to pass into the sound port. The protector of the invention is provided with a sound radiating element having at least a curve portion and a suspension part. The protector of the invention realizes a "perfect" barrier that attenuates the sound entering the audio device as little as possible and does not suffer from significant sound distortions.

24 Claims, 12 Drawing Sheets

(51) Int. Cl.
*H04R 1/10* (2006.01)
*H04R 1/28* (2006.01)
*H04R 11/02* (2006.01)

(52) U.S. Cl.
CPC ..... *H04R 1/2823* (2013.01); *H04R 11/02* (2013.01); *H04R 2225/023* (2013.01)

(56) References Cited

U.S. PATENT DOCUMENTS

2011/0268308 A1 11/2011 Vasquez
2018/0367926 A1* 12/2018 Marcher ..... H04R 1/1016

* cited by examiner

ACOUSTICAL PROTECTOR FOR AUDIO DEVICES AND AUDIO DEVICE PROVIDED WITH SAID PROTECTOR

This application is the U.S. national phase, filed under 35 U.S.C. § 371, of International Application No. PCT/IB2018/057666, filed Oct. 3, 2018, the entire contents of both are incorporated by reference herein.

BACKGROUND OF THE INVENTION

The present invention relates to an acoustical protector for audio devices, designed to allow sound to easily pass through it with minimal distortion while protecting the audio transducer from foreign material.

The invention relates also to the audio device provided with said protector.

An example of a device to be protected is a hearing aid dedicated to compensating for the wearer's hearing losses. The transducer (or loudspeaker) in a hearing aid which produces the amplified sound for the user is called a receiver. The receiver is usually located into the ear canal firing the sound towards the ear drum and the housing or body of the hearing aid is provided with an open sound port in front of the ear drum.

The known hearing aids of the completely-in-the-canal (CIC) type have the drawback that, when they are inserted into or removed from the wearer's ear, the ear wax is pushed into the receiver passing through the sound port of the device, thus causing the failure of the receiver.

Another example is a headphone that uses transducers similar to the hearing aid speakers to produce sound in a user's ear canal, either for voice communication or listening to music. As with the hearing aid, the receiver in these devices can become plugged with the ear wax from the user's ear.

Another example is a small portable speaker such as a Bluetooth speaker which is connected to a device such as a cell phone. These portable speakers are commonly used outside and in the elements where sand, dirt or water could get into them. Frequently small acoustic ports cannot be adequately protected from this foreign material. There is a need to keep foreign material out of these devices but still allow the sound to pass out of them.

The audio devices (receivers and microphones) are precision made devices which are easily damaged when foreign material finds its way into them. The foreign material varies depending on the environment, but some of the most common materials that acoustic devices have to deal with are dust, magnetized dust, sand and other heavier particles, water, water mixed with particles (i.e. mud and "grime"), skin cells, oils, and ear wax. Many particles are kept out with screens and finely woven meshes, but these "open porous" barriers invariably let some kind of undesirable foreign material through. The ideal situation is to have a barrier that blocks all foreign material, but yet lets the acoustic sound thorough unimpeded.

Sound can be thought of as small disturbances (or displacements) of air back and forth. Porous barriers are generally used in acoustic applications, because the acoustic disturbance can pass through the small porous openings. The smaller the pores, the more difficulty there is for the sound to pass through, and so the more attenuation the porous material will present to the sound. Since small pores are important to keep foreign material out, in general the more protection you want from foreign material, the more sound attenuation will occur. The goal is to have as little attenuation as possible.

If a "perfect" barrier is used, such as a flat membrane closing the sound port, then the barrier itself must move to let the sound disturbance pass from one side of the barrier to the other. However, such barriers have their own detrimental effect on the sound. If the density of the barriers is much greater than air (which is usually the case), then it can cause considerable sound attenuation. Also, the motion of the barrier can cause distortions to the sound, significantly degrading the sound quality. These distortions are especially an issue at high sound pressure levels.

As said before, some of the devices that the invention protects can have their sound port at the entrance of the ear canal or pushed deep into the ear canal. Cerumen, commonly called ear wax, and skin cells are the main foreign material that such audio devices have to contend with. However, cerumen isn't just a "wax", but due to the relatively high temperature inside of an ear canal, the cerumen can also be in a low viscosity liquid state, as well as a gas or vapor state. In the low viscosity liquid and vapor states, the cerumen can pass through porous materials making them relatively ineffective at keeping it out of the audio devices.

The audio transducer used for producing sound in many headphones and hearing aids are commonly referred to as a "receiver". A receiver is usually referred to as a "loud speaker" or just "speaker" in most other applications, but in these devices it is referred to as a "receiver". These receivers typically have a small tube or "sound port" that the sound is emitted from. Sound from these sound ports can be directly vented into the ear canal, or "piped" in through small diameter tubes that attach to the sound port.

SUMMARY OF THE INVENTION

Accordingly there is a need in the art for a "perfect" barrier that attenuates the sound entering the hearing device as little as possible and does not suffer from significant sound distortions. EP 2 493 216 A2 concerns a perforated barrier for the protection of hearing aid transducers. EP 0 835 042 A2 describes a protective device for hearing aids, provided with a flat barrier membrane, US 2011/268308 A1 relates to a partially occluding earbud adapter, adapted to grip inside the ear canal. U.S. Pat. No. 5,278,360 A illustrates a hearing aid wax guard provided with an internal supporting bridge, U.S. Pat. No. 5,150,417 A and JP H11 308689 A both describe loudspeaker systems.

This problem is solved by the acoustical protector for audio devices of claim 1. Further preferred embodiments of the device of the invention are characterized in the remaining claims.

BRIEF DESCRIPTION OF THE DRAWINGS

The acoustical protector of the invention is illustrated, by way of example, in the following drawings, wherein.

DESCRIPTION OF THE PREFERRED EMBODIMENTS

Figure 1:
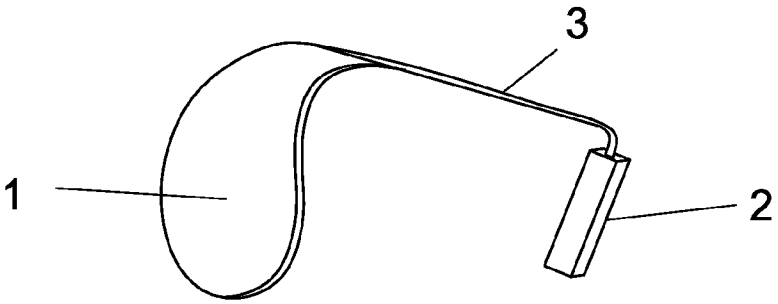
FIG. 1 illustrates the general structure of a hearing aid of the receiver-in-canal (RIC) type, provided with the protector of the invention.
Figure 2:
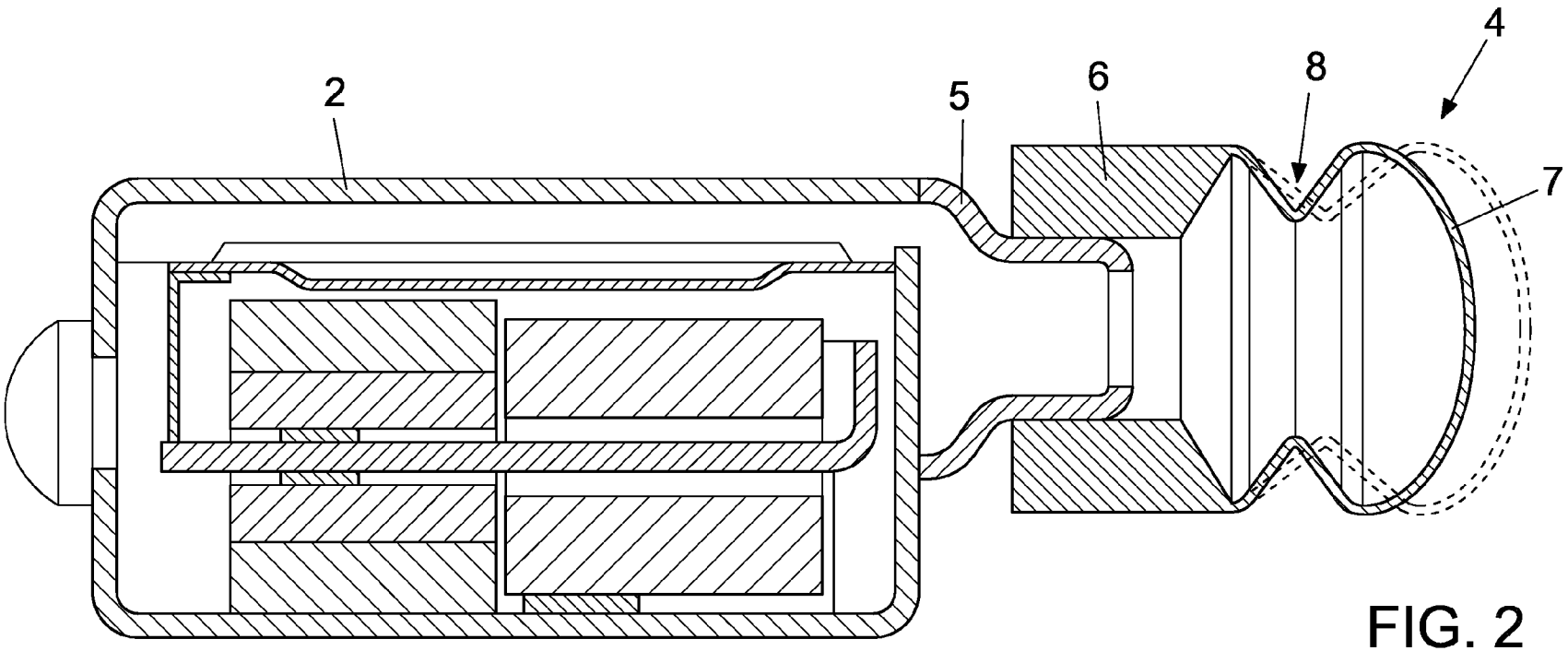
FIG. 2 illustrates a longitudinal section view of the receiver of device of FIG. 1 with the invention in place over the sound port.
Figure 3:
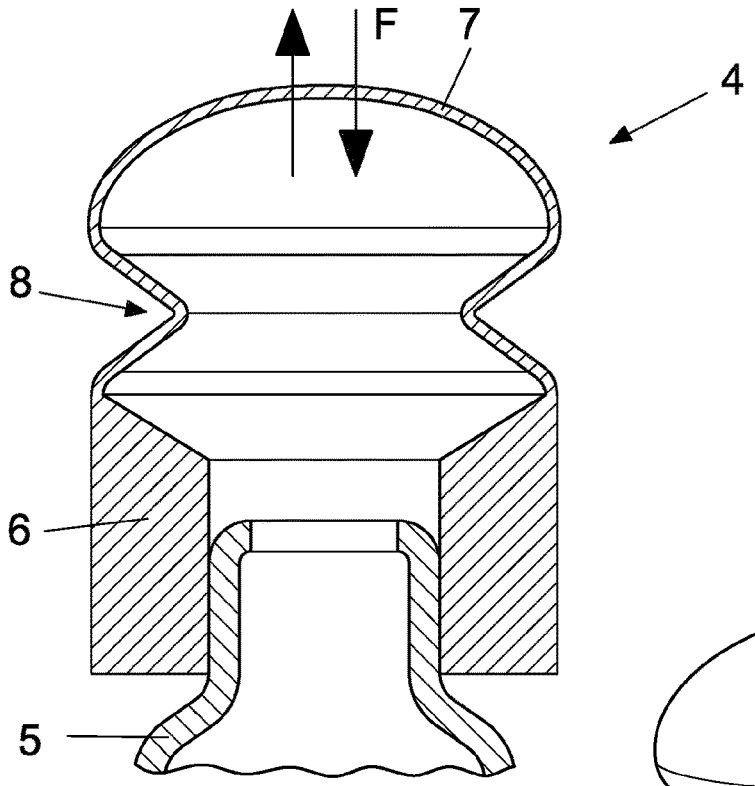
FIGS. 3, 4*a* and 4*b* illustrate a cross-section of a first embodiment of the device of the invention.
Figure 4A:
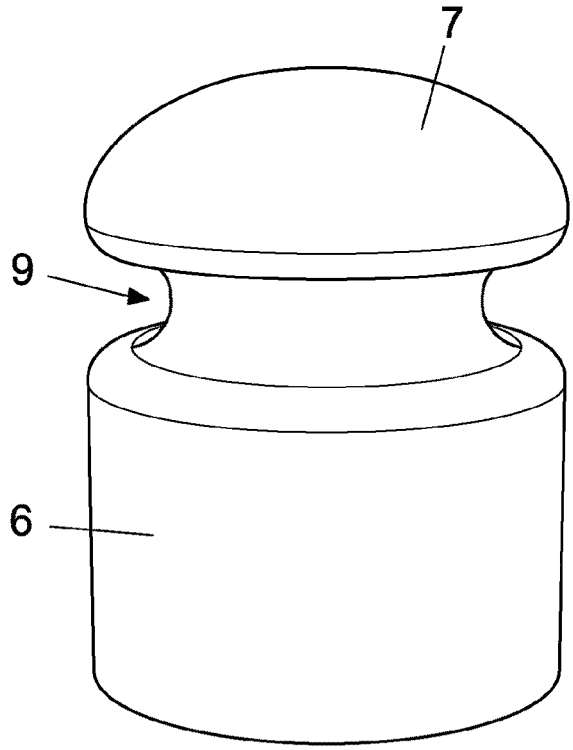
Figure 4B:
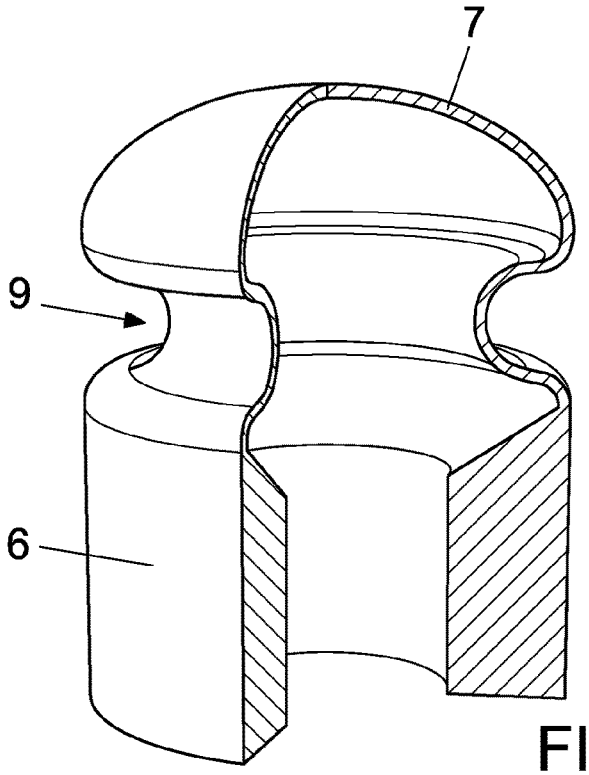

The protector of the invention is shown, in the example of FIG. 1, mounted on a hearing aid device which includes a body 1 containing the electronics and the power supply, connected to the sound generating transducer 2 via the electrical wiring 3. The device of the invention being disclosed is provided with (FIGS. 2 and 3):

- a curved shaped impermeable acoustical protector 4, including
- a neck part 6 for the retention function of the protector 4 on the sound port 5;
- a curved sound radiating element or dome 7 for transmitting the sound waves from the sound generating transducer 2 to the ear drum;
- a suspension part or bellows 8 for connecting the sound radiating element 7 to the neck 6 in a flexible way, allowing the sound radiating element to be displaced in a controlled way in the axial directions; according to the invention "controlled way" means that the radiating element 7 moves in the direction of the arrows F of FIG. 3 (axial direction with respect to the sound port 5), without changing the curved shape of the dome.

The protector 4 of the device of the invention allows sound to pass out of the sound port 5 but not allow any foreign material to enter into the sound port, damaging the receiver. The key parts of this dome design are the "bellows" structure of the suspension part 8 for linear motion and the "dome" structure of the sound radiating element 7 for rigidity.

In particular the suspension part 8 acts to allow the axial movements of the radiating element 7, necessary for the sound transmission from the transducer 2 to the ear drum. The curved shape of the sound radiating element 7 is necessary for maintaining the profile of this element during the sound transmission, avoiding deformations and subsequent acoustic distortions.

Figure 5:
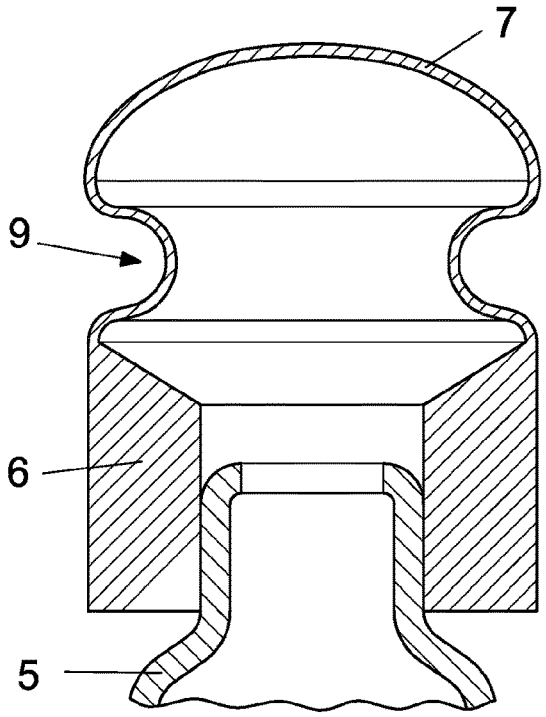
FIGS. 5, 5*a* and 5*b* illustrate different views of a second embodiment of the device of the invention.
Figure 5A:
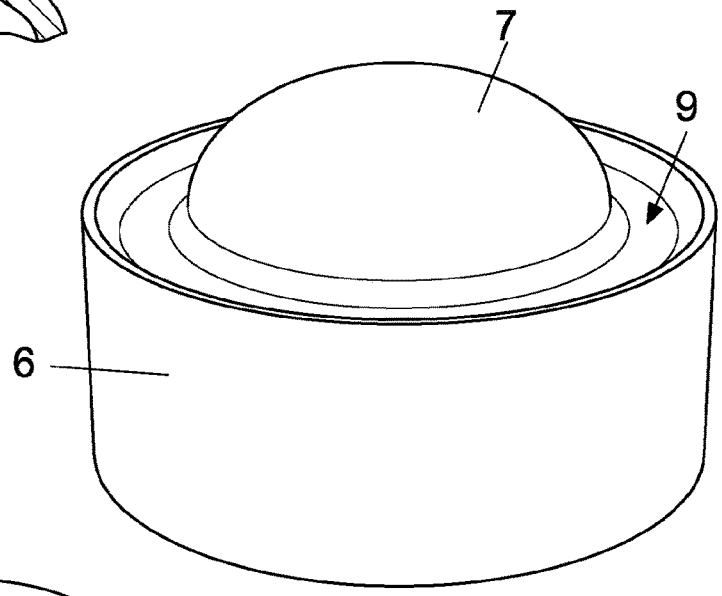
Figure 5B:
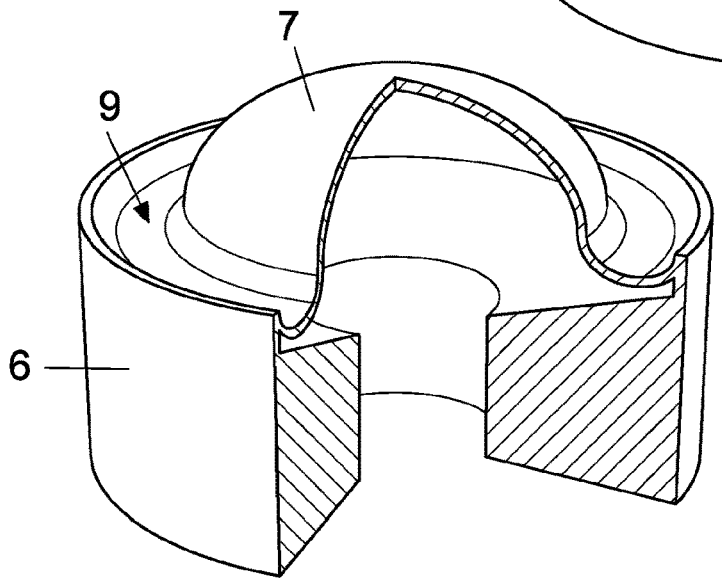

According to the embodiments of FIG. 5, a surround 9 is used instead of a bellows section. Here the neck is thicker to allow the device to connect to a sound port that has a smaller diameter.

Figure 6A:
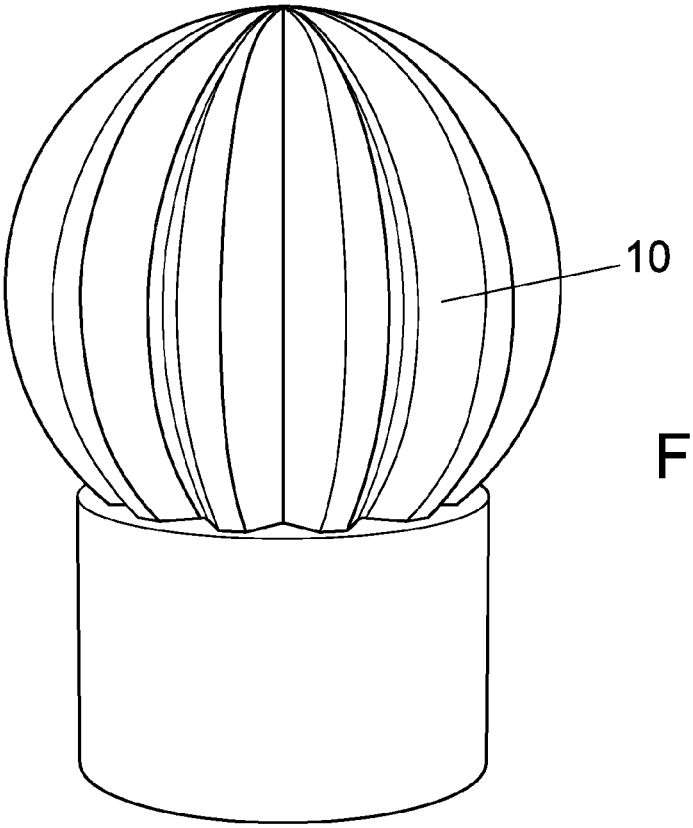
FIGS. 6*a* and 6*b* illustrate a third embodiment of the device of the invention.
Figure 6B:
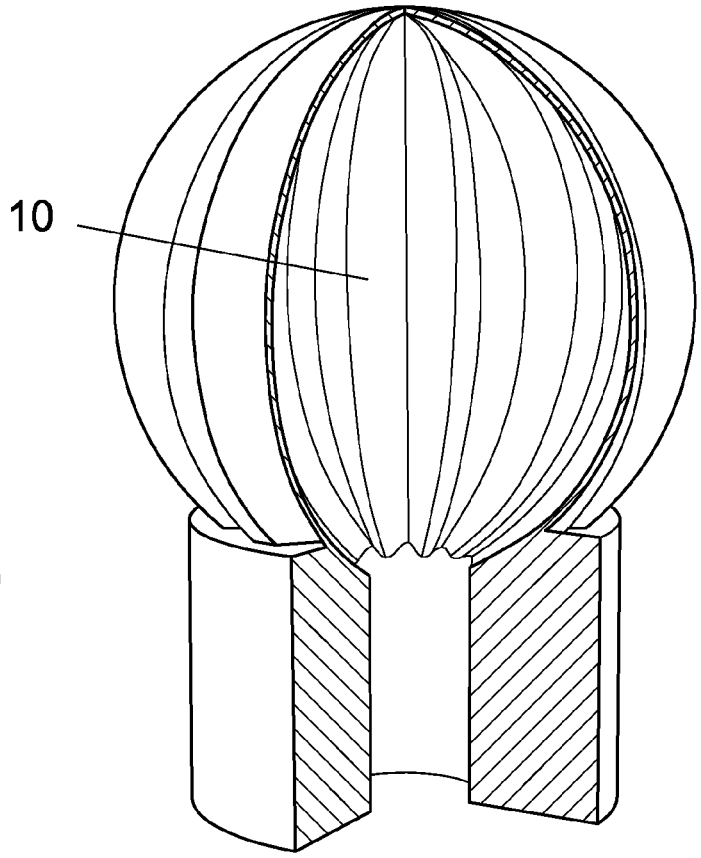

The diameter of the dome is preferably between 1 and 4 mm and the overall length of the device is preferably 3-8 mm. The material will be an easily deformed material such as silicone or some "rubber" material. However only the bellows 8 or the surround sections 9 need to be deformable. The dome 7 and/or neck 6 could be made from a much more rigid material such as PET. For clarity, dimensional sketches of the two concepts outlined above are shown in the FIGS. 4*a*,4*b* and 5*a*,5*b*. It is also possible to put radial pleats 10 into a circular dome 7 to allow sound through the device of the invention, as shown in the appended FIGS. 6*a* and 6*b*.

The general design goals for each section are given below.

Bellows/Surround Design Goals

Figure 7:
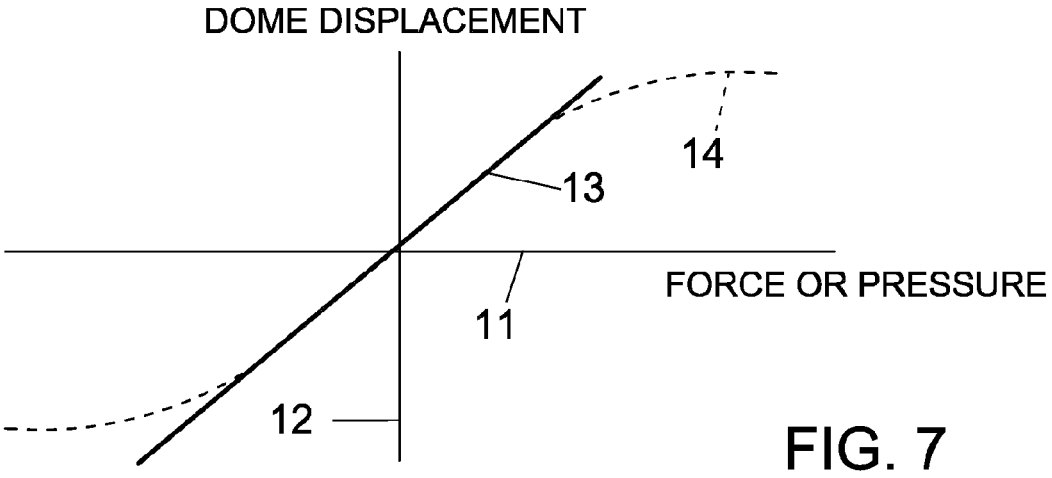
FIGS. 7 and 8 illustrate different behaviors of the device of the invention.

The bellows 8 or surround 9 allow the dome 7 to move and provide a spring behavior that brings the dome back to its "nominal" position. It is critical that the "spring rate" of the bellows/surround be as constant as possible over the dome's expected acoustic displacement range. When the displacement vs. pressure drop across the dome is plotted, this requires there to be a linear relationship between the two quantiles. Deviation from linear will generate nonlinear distortions in the audio signal that passes through the dome. The bellows/surround section is to be designed to maximize the linear range. In the FIG. 7 the axles 11,12 represent the pressure and the displacements respectively, the straight line 13 illustrates the linear behavior at low displacements and the line 14 represents the nonlinear behavior at large displacements leading to distortion.

Figure 8:
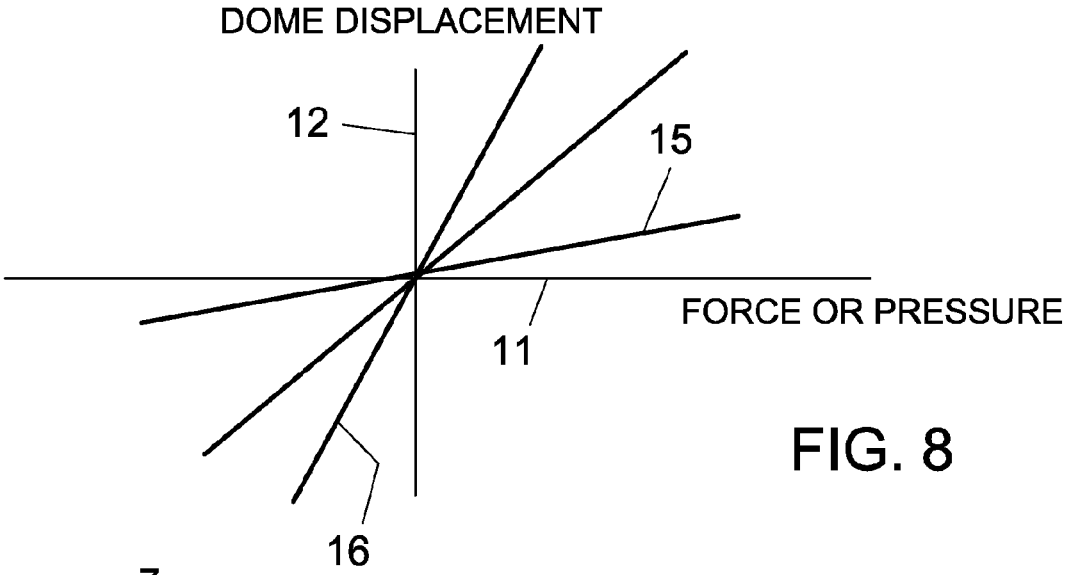

The slope of the line is also important. In general a higher slope is desired as this means the dome is easier to move, but must be optimized along with the rest of the design. In FIG. 8 the low slope 15 represents a stiff bellows which is generally less desirable and the high slope 16 represents a compliant bellows which is generally more desirable. The pressure range is up to about 140 dB SPL and the displacement is up to about 0.05 mm.

Figure 21:
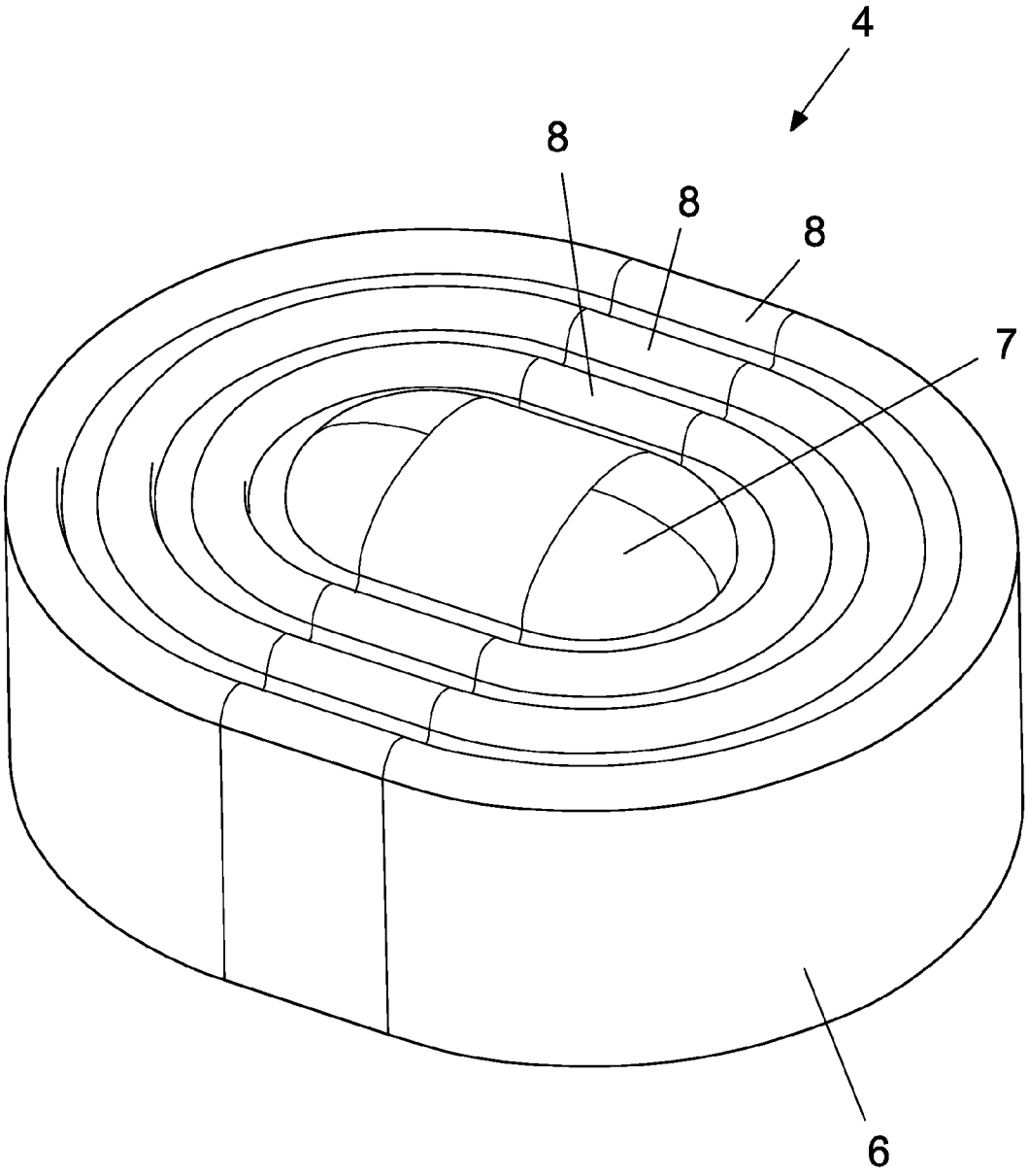

In the embodiment of FIG. 21 the protector 4 of the invention has an oval shape, having a suspension part 8 made by a plurality of coaxial alternate bends 8*a*.

Dome Design Goals

Figure 9:
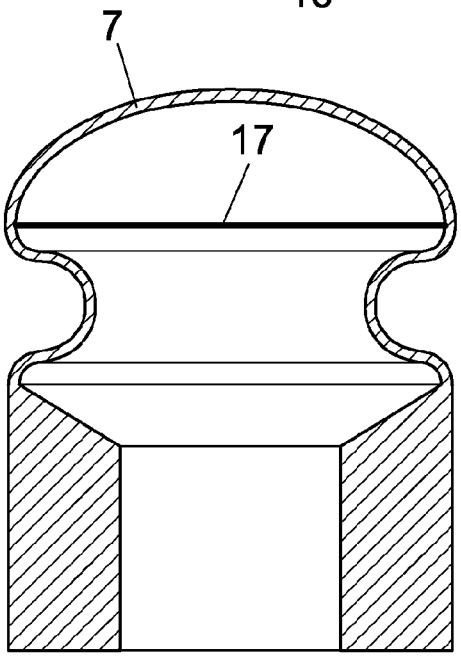
FIG. 9 illustrates the effective moving piston dome of the device of the invention.

When the dome 7 moves, it displaces a volume of air roughly equal to a circle with the same diameter as the dome, times how far the dome moves. This "circular" area will be referred to as the effective "moving piston" for the dome. In FIG. 9 is shown the effective moving piston 17 of the dome 7. Whereas a flat sheet suffers from nonlinear distortions and it limits the size of the dome structure to roughly the size of the neck, the dome structure 7 of the protector 4 of the device of the invention is the most rigid structure that can be designed (relative to a uniform pressure across its surface), and it can be made substantially larger than the neck, without introducing nonlinear displacement behavior due to its rigid behavior.

Making the dome 7 large is important, as the larger the dome, the less motion is required to achieve an equal amount of volumetric air displacement. So nonlinear stiffness behavior of the bellows is minimized. Also, the acoustical impedance of the dome is proportional to one over the dome diameter squared, so the larger the dome, the lower the acoustical impedance (acoustical impedance $\sim 1/d^2$, where d is the diameter of the dome). The larger the acoustical impedance, the more sound attenuation will result from the presence of the dome.

So again, the dome allows for the largest rigid structure possible, resulting in less distortion due to nonlinear stiffness behavior in the bellows and it results in lower acoustical impedance, lowering the sound attenuation through the device.

A perfect dome is not needed. The classic "arch" performs the same function as the dome: it spreads the load out across the structure thereby making it stronger.

The thickness of the dome wall will depend on the dome's material. In general you want the thickness to be large enough to prevent the dome from buckling under large acoustic pressures, and yet small enough to prevent it from having a large mass, increasing the acoustical impedance at high frequencies, which increases attenuation. The optimal thickness range will depend on the thickness of the dome.

For a dome constructed from Silicone, thickness from 0.5 to 10 thousandths of an inch are appropriate.

Variations on the Dome Design:

The material requirements of the bellows and the dome are quite different and there is a desire to make them of different materials. The bellows needs to be compliant, whereas the dome needs to be stiff and light. Silicone or rubber material is a good choice for the bellows, but a thin stiff material such as Kapton or PET would be the best choice for the dome. So, if possible, a construction that uses two different materials is desirable.

Figure 20A:
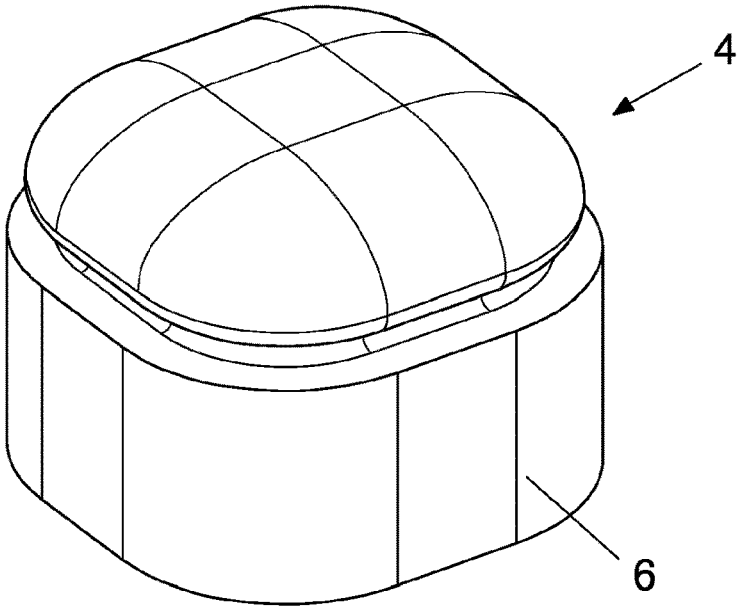
Figure 20B:
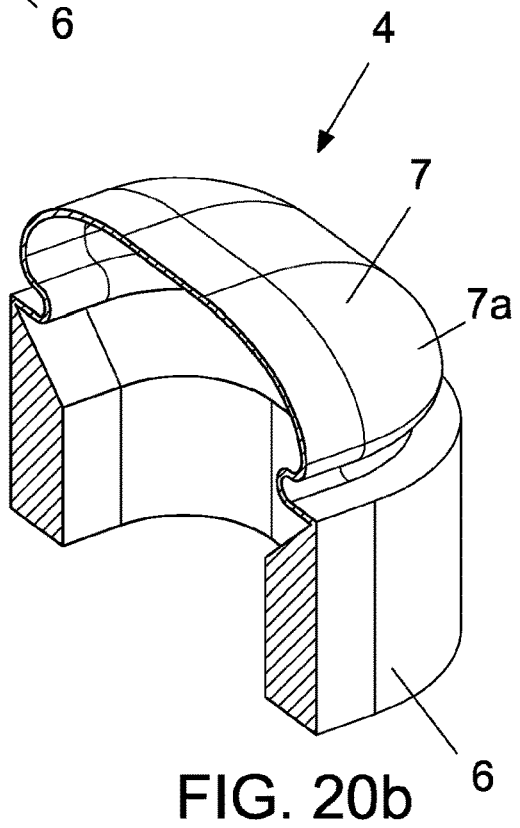
Figure 20C:
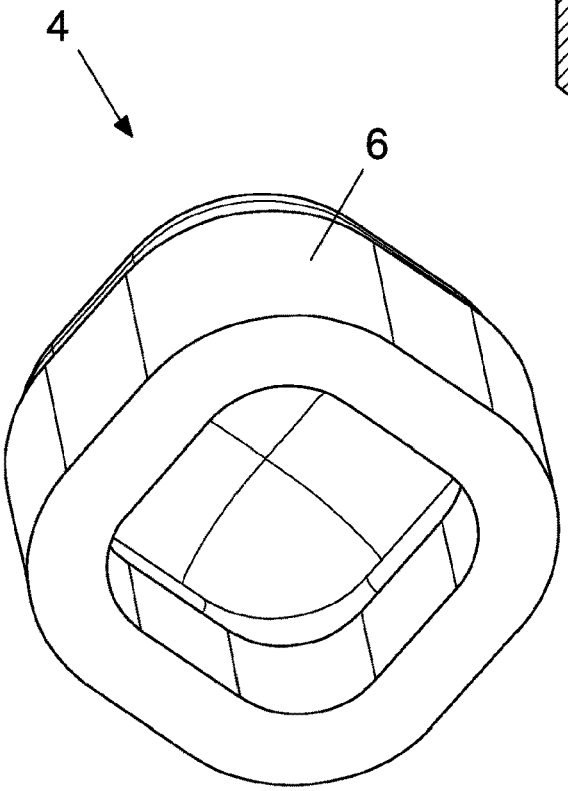

In the embodiment of the FIGS. 20*a*, 20*b*, 20*c* a rectangular version of the protector of the invention is shown, in which the dome 7 has a square base with rounded corners 7*a*, to show that a perfectly round shape of the dome is not a must for the invention. It is in fact sufficient that at least a curve portion 7*a* of the dome 7 is present.

Stiffening Ribs

Figure 10A:
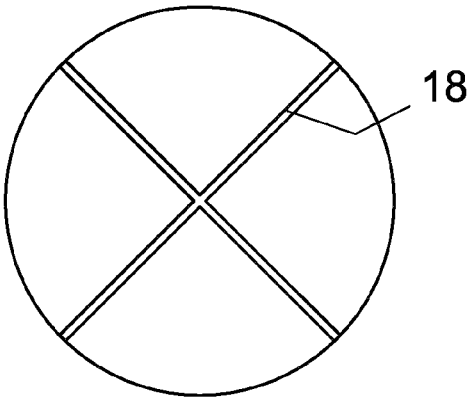
FIGS. 10*a*,10*b*; 11*a*,11*b*; 12*a*,12*b*; 13 to 17; 20*a*,20*b*,20*c* and 21 illustrate different embodiments of the dome of the device of the invention.
Figure 10B:
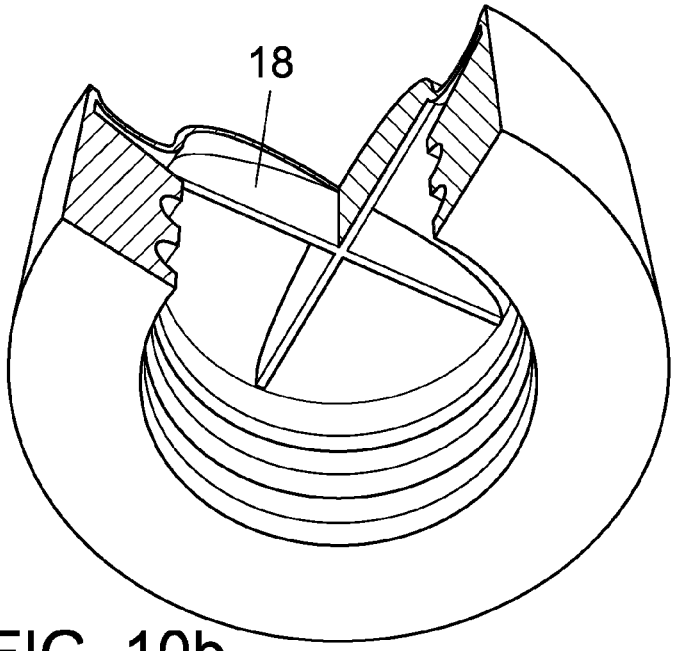

The dome 7 needs to be stiff but light. Having the dome be a solid body will maximize its stiffness, but also maximizes its weight. A design that places a support walls 18 in the dome is a good compromise. This is sketched in the FIGS. 10*a*,10*b* looking into the bottom of the dome.

Cleaning the Dome

There is a need to clean the acoustic dome, but putting a cleaning device onto the dome can cause the dome to invert and possibly make it difficult to return to its original dome shape. The X wall support 18 above will prevent this dome inversion from happening. An alternative to this is to use an insert that prevents the dome from being displaced too far. This will be discussed below under the "holder" section.

High Frequency

Figure 11A:
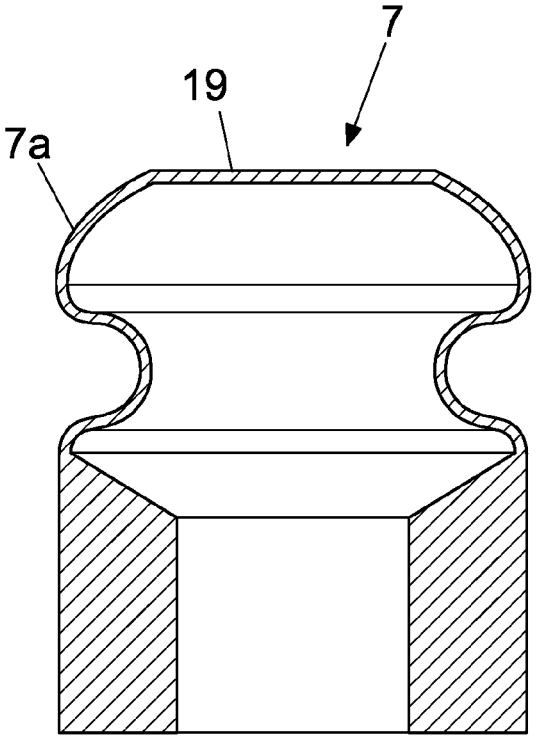
Figure 11B:
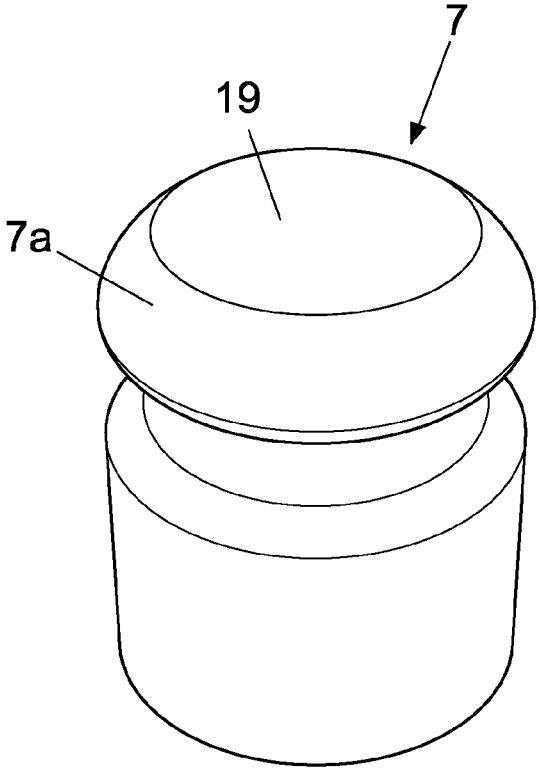

The mass of the dome 7 will limit the high frequency response of the dome. A thin membrane will have a low mass but will have a strong nonlinear stiffness curve that will prevent low frequencies from passing through. A good compromise is to place a flat membrane 19 onto the dome to allow high frequency to pass through, as shown in the FIGS. 11*a* and 11*b*, in which at least the presence of rounded corners 7*a* is maintained in the structure of the dome 7.

Pressure Equalization

If the audio device that the invention is to go onto is hermetically sealed, then atmospheric pressure changes can cause problems if there is not a means to equalize the static pressure inside of the invention with the atmospheric pressure.

There are several ways to achieve this. One is to place a very small hole through the dome. To prevent this from having an adverse effect on the invention's acoustic performance this hole would have to be less than 100 microns in diameter.

Alternatively, the "flat top" from the discussion above could be made from a different material with a very low air flow permeability such as expanded Teflon.

Figure 12A:
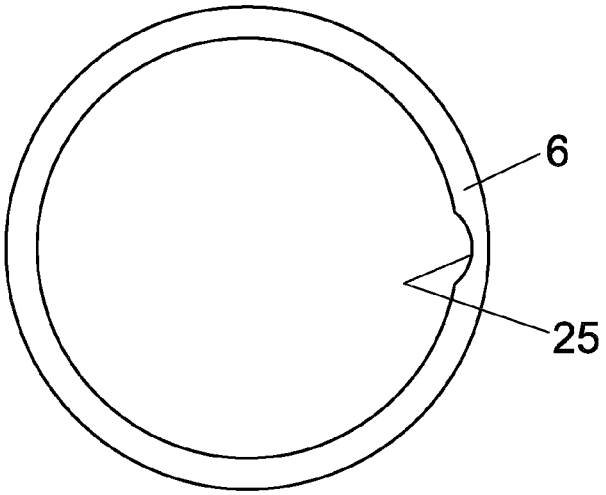
Figure 12B:
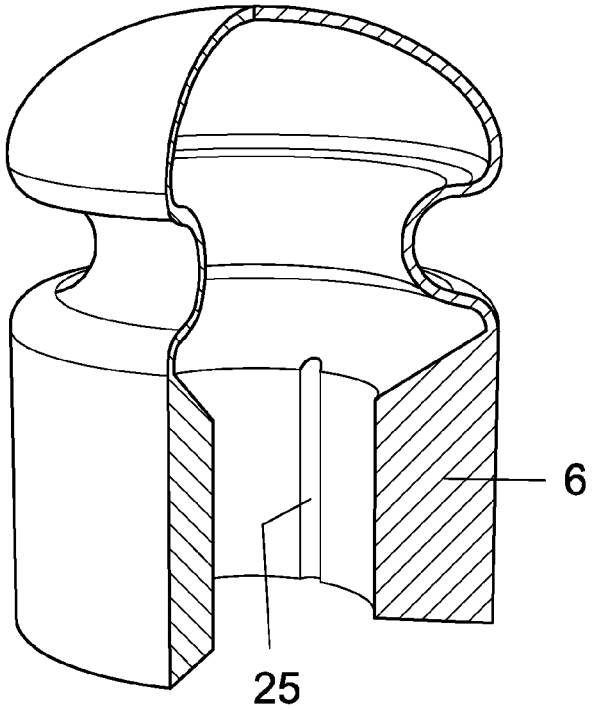

Alternatively the pressure equalization could be achieved by putting small channels 25 in the neck 6 of the FIGS. 12*a* and 12*b*. The longer this channel, the less effect it will have on the low frequency acoustic behavior and the lower the chance of any foreign material from getting under the dome.

Figure 13:
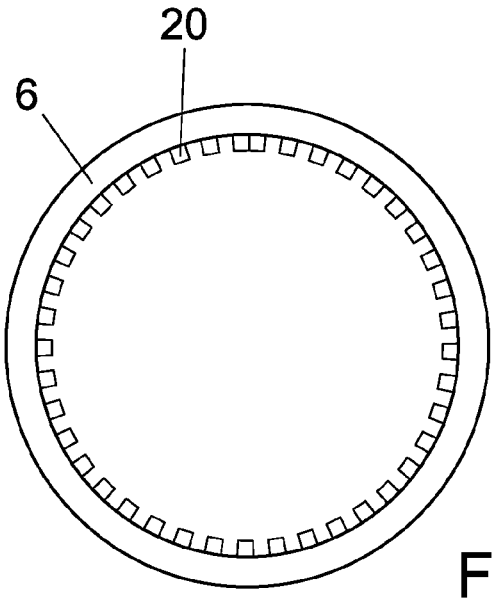

Alternatively a woven mesh 20 could be placed in a section of the neck 6 to form a small controlled gap between the neck and the receiver sound port to create the pressure equalization neck (FIG. 13).

Holder

Figure 14:
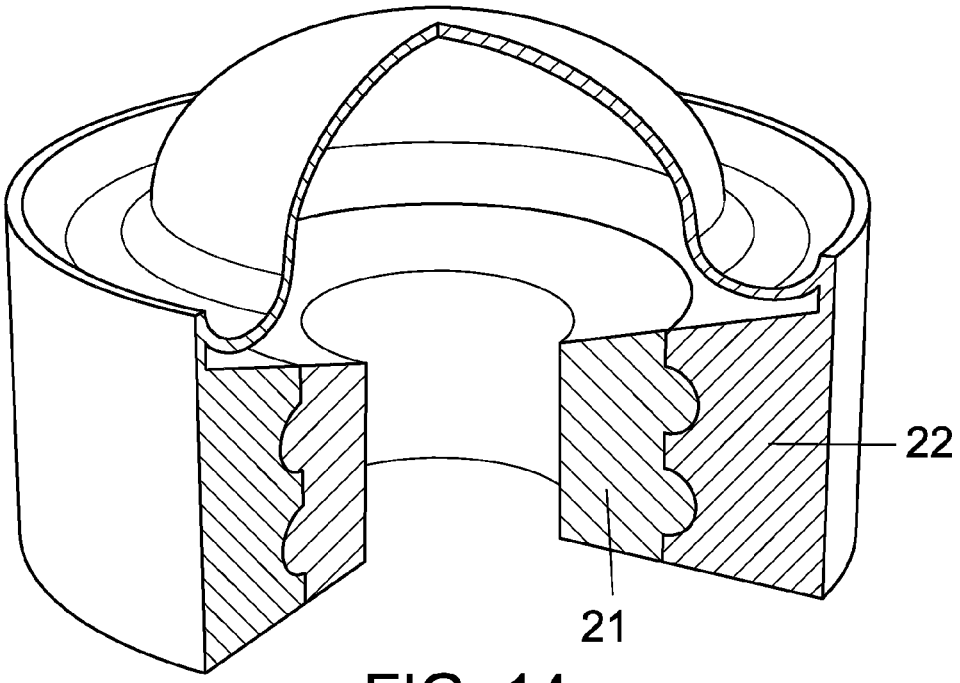

Holding the protector of the invention onto an acoustic port will be important. If the neck is made from the same flexible material as the dome, then the neck may not have sufficient compression force to keep the invention on the acoustic port. As an aid to keep it onto the port, holder 21 can be added with "nubs" 22 to mechanically retain the device (FIG. 14). The holder can be made from a more rigid material, such as a stiff plastic, which when slid over the acoustic port, it will not easily slide off. To keep the invention from sliding off of the holder, nubs are added to the holder and mating volumes in the invention to help the invention stay in place.

Figure 15:
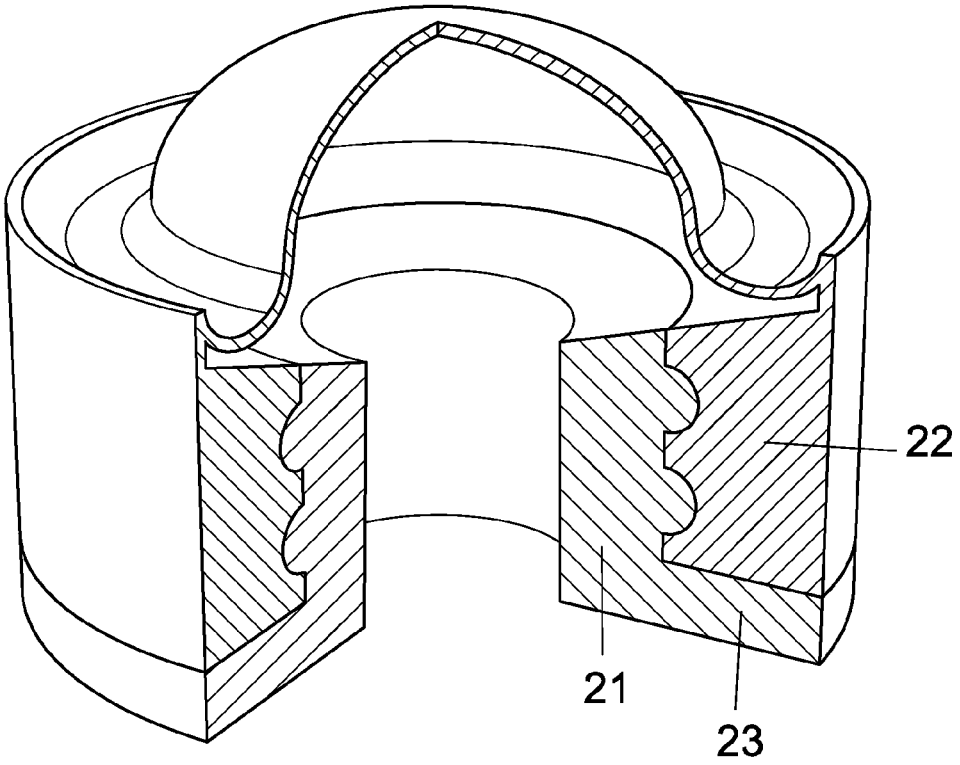

When the invention is pushed onto the holder 21, a retaining ledge 23 can be added to keep the invention from sliding past the retaining nubs 22 (FIG. 15).

Previously an "X" support structure 18 was added to the dome 7 to help prevent the dome from collapsing and possibly inverting during cleaning.

Figure 16:
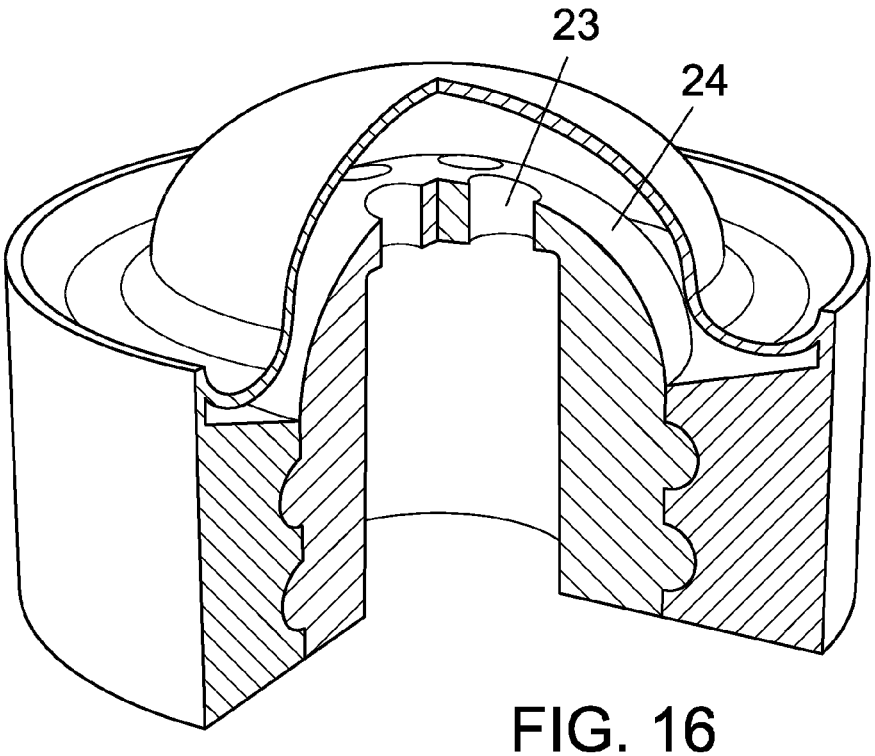
Figure 17:
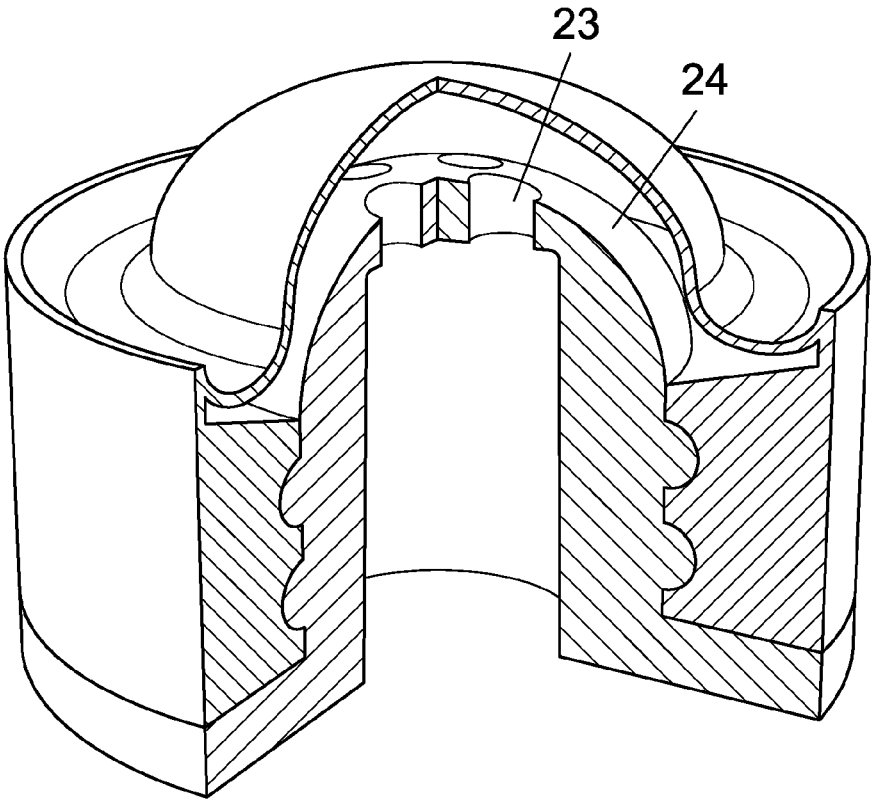

However, an extension 24 to the holder 21 can be used to prevent the dome from inverting during cleaning. This extension will need some perforations to allow sound through the dome-like extension (FIG. 16). A sketch of the holder with all three additions is shown in FIG. 17.

Variations

The material surface can be treated to be hydrophobic to repel water. Or a surface treatment that repels oils.

Applications

The main application that this is presently envisioned for is protecting a headset or hearing aid that is inserted into an ear canal from ear wax.

However, an acoustic dome can also be used to keep foreign material out of ports that are used on a variety of audio devices that port sound out through their structure. Cell phones and tablets are a possible use. Bass reflex ports on portable speakers are another application. In the case of a bass reflex port, the moving mass of the dome can actually be chosen to be large enough to enhance low frequency response.

Figure 18:
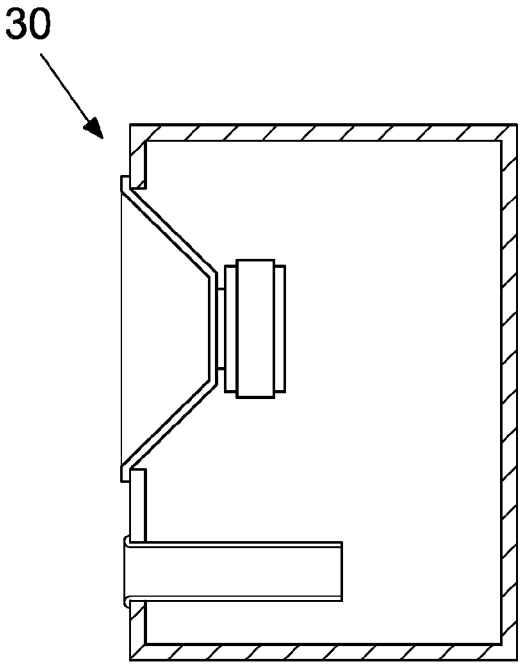
FIGS. 18, 19*a*, 19*b* and 19*c* illustrate a bass reflex speaker provided with the acoustical protector of the invention.
Figure 19A:
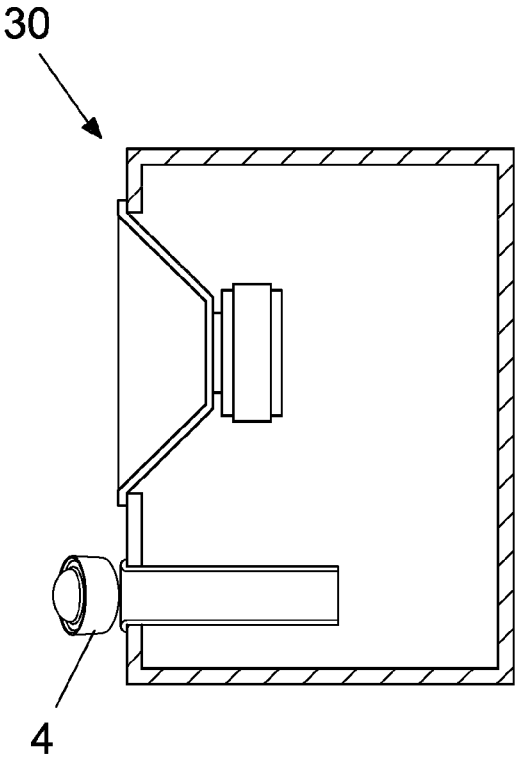
Figure 19B:
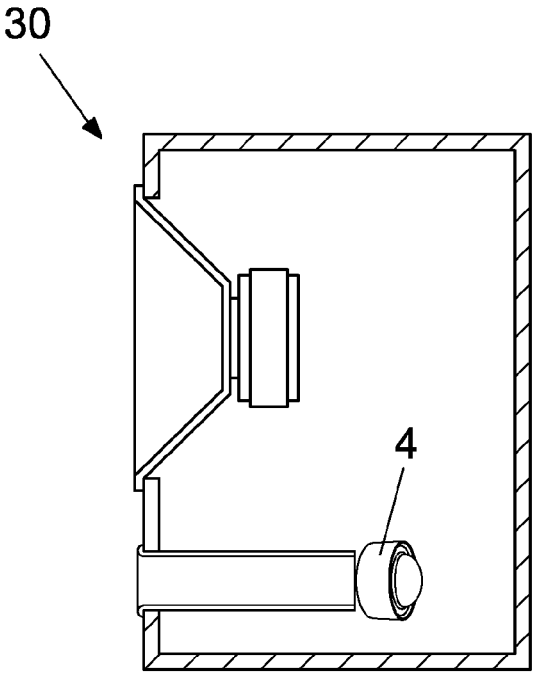
Figure 19C:
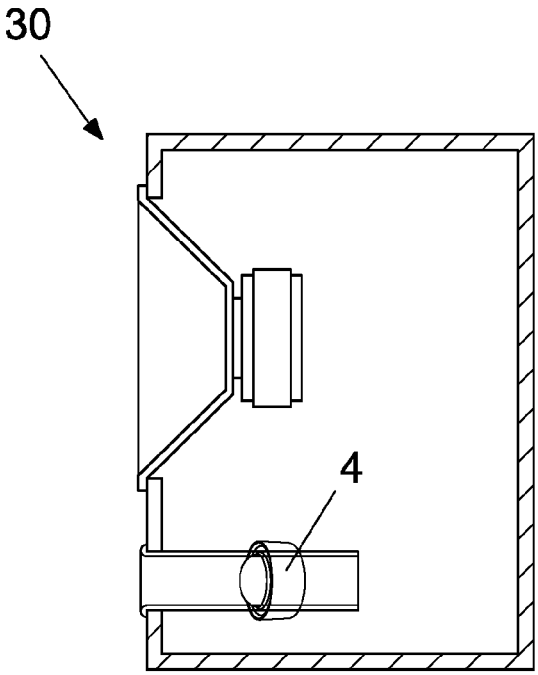

For example loud speakers on portable audio devices such as cell phones, tablets, or Bluetooth speakers frequently have sound ports which lead to internal components which can be damaged by foreign material such as dust, dirt and water. These sound ports are typically larger than those found on hearing aid or ear insert headphones. The invention of this patent can be increased in size to help protect these sound ports as well. FIGS. 18 and 19 show applying the invention to one of these ports in a bass reflex speaker.

In particular, as it is shown in the FIGS. 18,19*a*,19*b* and 19*c*, said audio device is a portable loudspeaker 30 with a sound port 26 covered by said protector 4 mounted at the outer end 27 of said port 26, or at the inner end 28 of said port 26 or in the inside portion of said port 26. The realization in these figures show a bass-reflex design where the acoustic mass of the air in the port resonate with the compliance of the rear air volume and create a boost to the low frequencies. The mass of the dome 7 is sufficiently large enough so that it enhances the acoustic behavior of said port 26 and so as to allow the length of said port 26 to be reduced. For instance, an air filled port that is 60 mm long and 10 mm in diameter can be replaced by a protector with the same diameter and a moving mass of the dome being 8 mg. This saves the space in the device by not requiring the long port.

In fact the protector of the invention can possibly go on either end of the port, or even possibly internally in the port. Sometime these ports are designed to have an acoustical mass to achieve a certain frequency response. The length of these ports frequently have to be longer than desired to achieve this acoustical mass. It is possible to design the moving mass of the invention's dome to produce some or all of this acoustic mass, thereby allowing for a shorter sound port. These ports are typically in the range of a 3 mm to 30 mm.

Applicator

The acoustic dome could be a replacement for existing so called "wax guards" on hearing aids. These wax guards typically require "applicators" that make it easier to remove and install new wax guards. The acoustic dome will likely also require an applicator to aid in its removal and installation.

Disposable

As with the current disposable wax guards, the acoustic dome could be disposable.

Cleanable

A major advantage of the acoustic dome over exiting wax guards is that the acoustic dome could be cleaned with a cleaning solution and something like a "Q-Tip".

The invention claimed is:

1. An acoustically transparent protector for an audio device comprising:

a dome; and a neck part for retention of said protector on a sound port of a sound generating transducer;

wherein said dome has at least a curve portion and a suspension part for connection to said neck part in a flexible way, in which said suspension part is formed along the movement direction of said dome, so that said dome is displaced in a controlled way in an axial direction with respect to said sound port, allowing the sound to pass through with little attenuation or distortion, but avoiding foreign material such as ear wax, dust, debris, or water to pass into the sound port, and wherein said suspension part includes an annular portion configured and arranged for movement in the axial direction.

2. The protector of claim 1, wherein said suspension part comprises a bellows or a surround section, and further wherein said suspension part is made of deformable material to allow for acoustic displacement of said dome.

3. The protector of claim 1, wherein the diameter of said dome is between 1 and 4 mm and the overall length of said audio device is 3-8 mm.

4. The protector of claim 1, wherein said dome is provided with radial pleats to allow for compliant motion of dome walls which permit sound to pass through the dome.

5. The protector of claim 1, further comprising support walls provided in said dome.

6. The protector of claim 1, further comprising a flat membrane provided as part of said dome to allow high frequency to pass through.

7. The protector of claim 2, further comprising at least one channel provided in said neck.

8. The protector of claim 2, wherein said protector further comprises a woven mesh adapted to be placed in a section of said neck to form a controlled gap between said neck and said sound port for pressure equalization.

9. The protector of claim 1, wherein said protector further comprises a holder adapted to mechanically retain said protector onto said sound port, wherein said holder has sufficient stiffness to secure said protector onto said sound port.

10. The protector of claim 9, wherein said holder has one or more nubs to aid in the mechanical retention of said protector onto said holder.

11. The protector of claim 9, wherein said holder has a retaining ledge to provide a stop to keep said protector from being pushed too far onto said holder.

12. The protector of claim 10, further comprising an extension to said holder that includes one or more acoustic pathways provided to prevent said dome from inverting.

13. An audio device comprising:

a sound generating transducer having a sound port; and a protector covering said sound port;

wherein the protector comprises:

a dome; and a neck part for the retention of said protector on a sound port of a sound generating transducer;

wherein said dome has at least a curve portion and a suspension part for connection to said neck part in a flexible way, in which said suspension part is formed along the movement direction of said dome, so that said dome is displaced in a controlled way in an axial direction with respect to said sound port, allowing the sound to pass through with little attenuation or distortion, but avoiding foreign material such as ear wax, dust, debris, or water to pass into the sound port, and wherein said suspension part includes an annular portion configured and arranged for movement in the axial direction.

14. The audio device according to claim 13, wherein said audio device is a hearing aid device comprising a body containing electronics and a power supply, connected to a receiver via electrical wiring.

15. An audio device comprising:

a sound generating transducer having a sound port; and a protector covering said sound port;

wherein the protector comprises:

a dome; and a neck part for the retention of said protector on a sound port of a sound generating transducer;

wherein said dome has at least a curve portion and a suspension part for connection to said neck part in a flexible way, in which said suspension part is formed along the movement direction of said dome, so that said dome is displaced in a controlled way in an axial direction with respect to said sound port, allowing the sound to pass through with little attenuation or distortion, but avoiding foreign material such as ear wax, dust, debris, or water to pass into the sound port, and wherein said audio device is a portable loudspeaker provided with said protector in which a moving mass of the dome can actually be chosen to create a bass-reflex enhancement to low frequency response.

16. The audio device of claim 15, wherein the portable loudspeaker with the sound port covered by said protector is mounted at an outer end of said port, or at an inner end of said port, or in an inside portion of said port.

17. The audio device according to claim 13, wherein said audio device is a cell phone provided with said protector in which a moving mass of the dome can actually be chosen to create a bass-reflex enhancement to low frequency response.

18. The audio device according to claim 13, wherein said audio device is a tablet provided with said protector in which a moving mass of the dome can actually be chosen to create a bass-reflex enhancement to low frequency response.

19. The protector of claim 1, wherein:

said dome is configured and arranged to be displaced between a first position and a second position, said second position is a position that is more linearly displaced from said neck part than said first position, and at least when said dome is in said second position, an innermost peripheral portion of said annular portion of said suspension part is smaller than an outermost peripheral portion of said dome.

20. The protector of claim 1, wherein:

said dome is configured and arranged to be displaced between a first position and a second position, said second position is a position that is more linearly displaced from said neck part than said first position, and at least when said dome is in said first position, an innermost peripheral portion of said annular portion of said suspension part is larger than an outermost peripheral portion of said dome.

21. The protector of claim 1, wherein said suspension part comprises a bellows.

22. The protector of claim 1, wherein said suspension part comprises at least one surround section that surrounds said dome.

23. The protector of claim 22, wherein said at least one surround section is of a generally oval shape.

24. The protector of claim 13, wherein said suspension part comprises a bellows or a at least one surround section that surrounds said dome.

* * * * *